US006315579B1

(12) United States Patent
Murakami et al.

(10) Patent No.: US 6,315,579 B1
(45) Date of Patent: Nov. 13, 2001

(54) ELECTRIC CONNECTION BOX

(75) Inventors: Masakazu Murakami, Hikone; Keiji Edamura, Suzuka, both of (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/572,655

(22) Filed: May 16, 2000

(30) Foreign Application Priority Data

May 21, 1999 (JP) ..... 11-141535

(51) Int. Cl.[7] ..... H01R 9/09
(52) U.S. Cl. ..... 439/76.2; 439/488
(58) Field of Search ..... 439/76.2, 488, 439/489, 490, 491

(56) References Cited

U.S. PATENT DOCUMENTS 4,469,128 * 9/1984 Petrimaux et al. ..... 137/554
4,911,651 * 3/1990 Jego et al. ..... 439/207

* cited by examiner

*Primary Examiner*—Gary Paumen
*Assistant Examiner*—Alexander Gilman
(74) *Attorney, Agent, or Firm*—Oblon, Spivak, McClelland, Maier & Neustadt, P.C.

(57) ABSTRACT

An electric connection box includes a casing formed with an inspection window, and an electrical connecting component accommodated in the casing. An identification mark attached to an outer face of the electrical connecting component indicates a production facility employed for production of the connecting component. Even when a number of electrical connecting components of the same kind are manufactured with use of a plurality of production facilities, it is possible to determine the facility employed for the production of the electrical connecting component accommodated in each individual electric connection box from outside of the connection box by visually confirming the identification mark attached to the electrical connecting component through the inspection window.

8 Claims, 4 Drawing Sheets

ELECTRIC CONNECTION BOX

CROSS-REFERENCE TO RELATED APPLICATIONS

This application is related to and claims priority, under 35 U.S.C. §119, from Japanese Patent Application No. 11-141535, filed on May 21, 1999, the entire contents of which are hereby incorporated by reference herein.

BACKGROUND OF THE INVENTION

1. Field of the Invention

The present invention relates to an electric connection box mounted to a vehicle such as a passenger car.

2. Discussion of Background

To satisfy a growing demand for improved passenger comfort, the electrical components mounted in a vehicle are increasing in number, which components may include audio system, navigation system, television, electrically-powered antenna, air conditioner, rear-wind heater, seat heater, electrically-powered seat, and suspension-stiffness controller.

The vehicle-mounted electrical components are supplied with electric power from a battery and operated under the control of a controller. Usually, the battery and the controller are disposed in the engine room and the passenger compartment, respectively, whereas the vehicle-mounted electrical components are disposed at various parts of the vehicle body, so that complicated wiring is required for electrical connection between the vehicle-mounted electrical components, the battery and the controller. For convenience of wiring, an electric connection box and wire harnesses are generally employed, the harnesses extending between the connection box, the battery, and the controller.

An electrical connection box is exemplarily shown at 50 in FIG. 5. The connection box 50 mainly includes: upper and lower cases 51, 52 assembled into one piece; a wiring board 53 interposed between the upper and lower cases 51, 52; and bus bars 55, 56 mounted on opposite first and second surfaces, respectively, of the wiring board 53 for distributing large electric currents. Electrical parts, including fuses, relays, and terminals, adapted for connection with wire harnesses, are mounted on the upper and lower cases 51, 52. The fuses serve as protective measures against overcurrent that can be generated when a wire harness is short-circuited with the vehicle body or an electric load, such as an electric motor, becomes faulty for any reason.

The wiring board 53, formed by resin injection molding, for instance, is formed with reinforcing ribs for providing the wiring board 53 with desired mechanical strength and vibration resistance. The wiring board 53 has opposite faces thereof formed with wiring grooves in which continuous wires W are installed with the use of a wiring machine. The continuous wire W are cut, where required, to form desired electrical connecting circuits. Further, press-fitted terminals 54 for establishing electrical connection between corresponding ones one the wires and the electrical parts, such as fuses, are mounted on the wiring board 53. The wiring board 53 cooperates with the wires W, the terminals 54, and the bus bars 55, 56, to constitute an electrical connecting component (internal component) 57 received in the upper and lower cases 51, 52.

To fabricate electrical connecting components 57 each having a number of constituent elements, such as the wire W, the wiring board 53, the terminals 54, and the bus bars 55, 56, complicated assembling work, which may include many steps, is required. Thus the cycle time for fabricating the electrical connecting component 57 is generally longer than that of a subsequent step of assembling the cases 51, 52 and the internal component 57 into one piece. This causes a reduction in production efficiency of electric connection boses. In order to improve the production efficiency by shortening an apparent cycle time of production of the electrical connecting component 57 to the extent that it becomes nearly equal to that of the subsequent assembling step, a plurality of production facilities, each including a wiring machine and a terminal press-fitting machine, can be employed for production of electrical connecting components 57 of the same kind.

Defective electrical connecting components 57 can be manufactured if any one of the production facilities is faulty in operation. For instance, if one of the wiring machines becomes faulty, wires W are inappropriately installed on the wiring boards 53 concerned. If a molding die for forming wiring boards 53 is defective or if an amount of resin injected is insufficient, a defective formation of reinforcing ribs can occur in the associated wiring boards 53. In such cases, defective products to be discarded must be discriminated from non-defective products. However, a proper discrimination of defective products cannot be made when a plurality of production facilities are employed for the production of electrical connecting components 57 in particular.

That is, if a faulty operation of a certain production facility has been overlooked for a long time and defective electrical connecting components have been one incorporated into the cases (casing) of electrical connecting boxes, it becomes impossible to specify those electrical connecting boxes, which accommodate defective components therein, by external inspection. Although electric connection boxes are labeled with an indication, such as a manufacturer's serial number, discrimination between defective products and non-defective products cannot usually be made based on the serial numbers alone. Thus, all the products, including defective and non-defective products manufactured during the period in which at least one production facility was abnormally operated, must be repaired or discarded to eliminate the fear of shipment of defective products, resulting in a waste in costs.

SUMMARY OF THE INVENTION

An object of the present invention is to provide an electric connection box making it possible to identify from outside, among production facilities, a production facility actually employed for production of an internal component already accommodated in a casing of each individual electric connection box.

According to the present invention, an electric connection box is provided, which includes: a casing; an internal component accommodated in the casing; an identification mark provided on an outer surface of the internal component for indicating a production facility employed for production of the internal component; and an inspection window formed in the casing for permitting inspection to ascertain the identification mark from outside of the casing.

According to the electrical connection box of the present invention, inspection can easily be made from outside of the electric connection box to ascertain whether the internal component, accommodated in each individual electric connection box, was fabricated by a production facility whose operation was faulty, even after internal components, produced by a plurality of production facilities, at least one of which was defective in operation, are already incorporated into electric connection boxes.

In the present invention, preferably, the identification mark has a different shape or color for each of the production facilities employed for production of internal components of the same kind. Alternatively, the identification mark is provided at a different location on the outer face of the internal component for each of the production facilities.

In this case, on the basis of the shape, color, or location of the identification mark, whether or not each individual internal component was fabricated by a faulty production facility can be easily ascertained from outside of the electric connection box.

Alternatively, the identification mark specifies a molding die employed for production of the internal component. In this case, on the basis of the identification mark, discrimination can be easily made from outside of the electric connection box as to whether or not the internal component was fabricated by using a defective molding die or a molding die which entailed injection shortage.

In the present invention, the internal component may be an electrical connecting component including a wiring board, for instance. The wiring board may be formed with a wiring groove in which a wire is installed. The casing may be comprised of an upper case and a lower case. These cases and the electrical connecting component disposed therebetween can be assembled into one piece.

The electric connection box according to this preferred arrangement is fabricated by performing a preceding step of fabricating the electrical connecting component serving as the internal component and a subsequent step of assembling the electrical connecting component to the casing. Generally, the cycle time of the preceding step is longer than that of the subsequent step, lowering the efficiency in production of electric connection boxes. This preferred arrangement makes it possible to easily determine whether or not the internal component accommodated in each individual electric connection box was manufactured by a production facility which was faulty in operation, even if a plurality of production facilities for the preceding step are employed for the production of electrical connecting components (internal components) of the same kind. Thus, the efficiency of production of electric connection boxes can be improved by performing the preceding step with use of a plurality of facilities to thereby make an apparent cycle time of the preceding step equal to the cycle time of the subsequent step, while eliminating fears of occurrences of waste such as discard of all the internal components manufactured by the production facilities during the period in which at least one production facility was abnormally operated.

For instance, the identification mark is configured to be visually identified by a worker through the inspection window. In this case, the worker can easily determine whether the internal component accommodated in each individual electric connection box is defective or not, without the need of using a special inspection device.

DETAILED DESCRIPTION OF THE PREFERRED EMBODIMENTS

With reference to the appended drawings an electric connection box according to an embodiment of the present invention will be explained.

Figure 1:
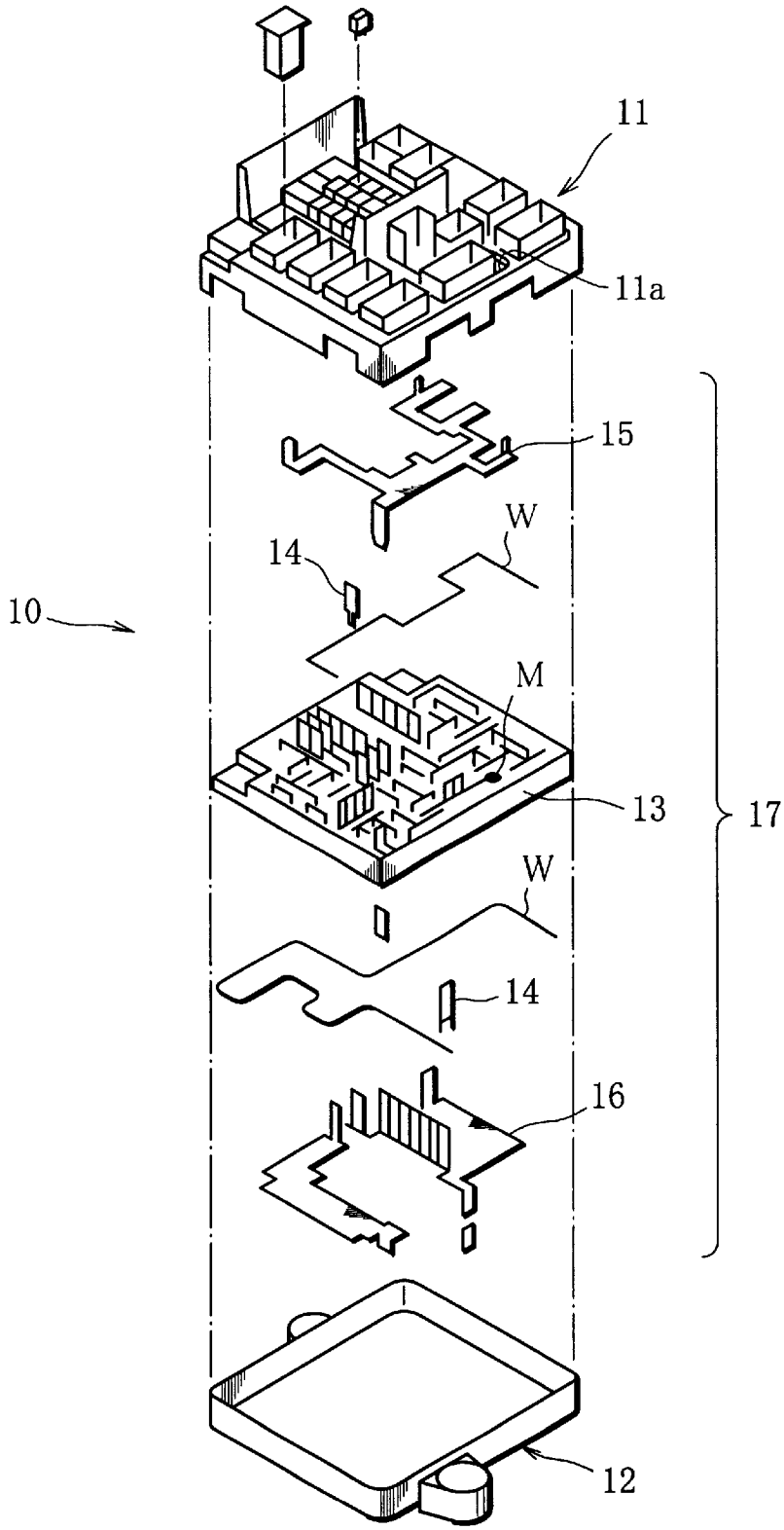
FIG. 1 is an exploded perspective view showing an electric connection box according to an embodiment of the present invention.

As shown in FIG. 1, the electric connection box 10 of this embodiment includes: an upper case 11 having electrical parts, such as fuses, mounted thereon and being formed with connecting terminals adapted for electrical connection with wire harnesses; a lower case 12 having relays mounted thereon; and a wiring board 13 made of resin and interposed between the upper and lower cases 11, 12. The wiring board 13 has opposite faces thereof formed with wiring grooves therein and in which wires W for small-current conduction are installed and terminals 14 are press-fitted. The wiring board 13 cooperates with the terminals 14 and bus bars 15, 16 to form an internal component 17 accommodated in the upper and lower cases 11, 12. These cases 11, 12, in which the internal component 17 is received, are assembled into one piece. The bus bars 15 and 16 for large-current conduction are interposed between the upper case 11, and the wiring board 13 and between the wiring board 13 and the lower case 12, respectively.

A label is attached to a predetermined location of an outer face of the wiring board 13, the label being provided with an identification mark M (indicated by ● in FIG. 1) which specifies a wiring machine actually employed for wiring work on the wiring board 13, among wiring machines constituting part of a plurality of production facilities installed for production of internal components 17.

The upper case 11 is formed with an inspection window 11*a* which permits inspection, preferably a visual inspection by a worker, for ascertaining the identification mark M, attached to the wiring board 13, from outside the upper case 11. The location at which the inspection window 11*a* is formed corresponds to the location where the identification mark M is positioned when the wiring board 13 is fitted to the upper case 11. In this embodiment, the inspection window 11*a* opens to the outer face of the upper case 11. That is, the identification mark M provided on the upper face of the wiring board 13 can be visually identified from above the upper case 11 through the inspection window 11*a*. A transparent plate may be fitted to the opening, i.e., the inspection window, to provide the connection box 10 with a waterproof ability.

The provision of the inspection window 11*a* makes it possible to easily specify a wiring machine, which was employed for wiring work on the wiring board 13 in question, from outside of the assembled electric connection box.

The identification mark M is determined in advance so as to correspond to each individual wiring machine. In this embodiment, the marks ●, ♦, and ★ respectively corresponding to three wiring machines are used.

Figure 2:
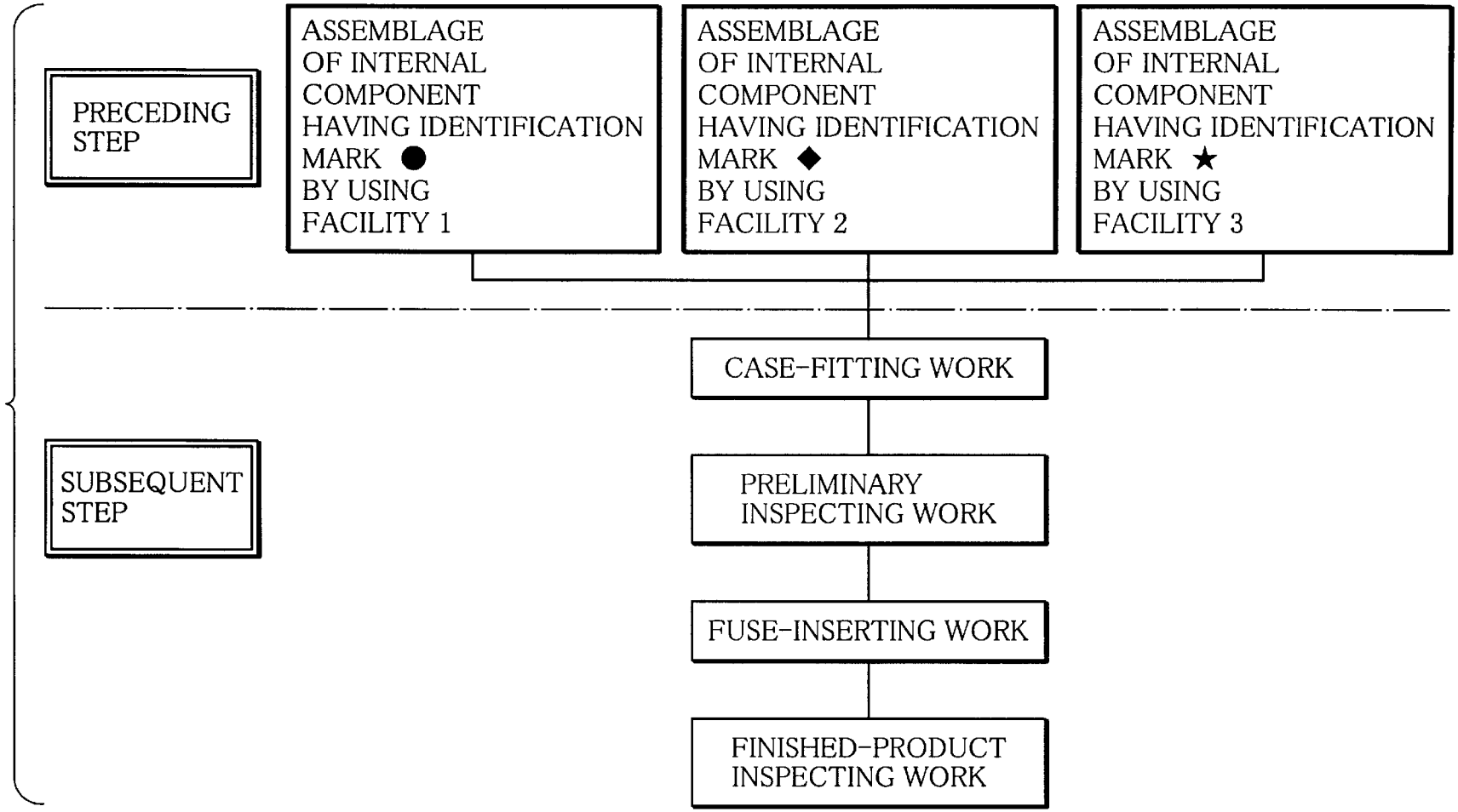
FIG. 2 is a schematic diagram showing steps of manufacturing the electric connection box shown in FIG. 1.

As shown in FIG. 2, the electric connection box 10 is manufactured by performing first and second steps (preceding and subsequent steps). In the first step, the electrical connecting component 17 is manufactured by installing the wire W on the wiring board 13 with use of a corresponding one of the wiring machines and by press-fitting the terminals 14 to the wiring board 13. The second step includes fitting work for mounting the electrical connecting component 17 to the upper and lower cases 11, 12.

The fitting work is followed by preliminary inspecting work, fuse-inserting work, and finished-product inspecting work, which are carried out in sequence on an assembly line.

Typically, the wiring machine of each facility for performing the preceding step requires 180 seconds to carry out the wiring work on each electrical connecting component 17, whereas each of facilities for performing the case fitting work, preliminary inspection work, fuse-insertion work, and finished-product inspection work in the subsequent step requires 60 seconds to carry out the work on each electric connection box 10. To manufacture electric connection boxes 10 at a rate of 60 seconds per connection box in this typical example, three wiring machines of the same kind must be employed to supply the electrical connecting components 17 at a required rate to the subsequent step. Hereinafter, three facilities for the preceding step, each including a corresponding one of the three wiring machines, will be referred to as the facilities 1, 2 and 3, respectively. The electrical connecting components supplied from the facilities 1, 2 and 3 are attached with different identification marks (identification seals) M, i.e., the marks ●, ♦, and ★, respectively. These electrical connecting components 17 each attached with the identification mark M are assembled to the upper and lower cases 11, 12 in the subsequent step, thereby obtaining electric connection boxes 10.

In a conventional method where each electric connection box 50 is solely provided at the casing surface with an indication of product type, it is impossible to specify which facility was employed, among a plurality of facilities, for production of each individual electrical connecting component, from outside the connection box after completion of fabrication of the box. Contrary to this, the electrical connection box 10 of this embodiment enables a worker to visually confirm the identification mark M through the inspection window 11*a* formed in the upper case 11, to thereby easily ascertain which facility 1, 2 or 3 was employed for the production of the electrical connecting component 17 accommodated in the electric connection box even after the completion of assemblage of the connection box. For instance, if the fact that the facility 1 was abnormally operated is found at a later date, only those electric connection boxes each accommodating the electrical connecting component attached with the mark ● can be discriminated as being faulty products that must be repaired or discarded. In other words, unlike the prior art, the electric connection boxes accommodating the electrical connecting components, manufactured by normally-operated facilities during the time the operation of the facility 1 was faulty, can be shipped, so that it is unnecessary to discard all the products manufactured during the time any one of the facility was abnormally operated, to fully eliminate fears of shipment of defective products.

Instead of using the identification mark M having the shape different between the production facilities, the identification mark M may be applied with color which is different between the facilities. For instance, electrical connecting components 17 respectively fabricated by the facilities 1, 2 and 3 may be applied with different identification marks M which are red, yellow and blue in color, respectively, but have the same shape such as ●.

In providing each electrical connecting component 17 with the identification mark M, it is not inevitably necessary to attach the identification seal having the identification mark M to the component 17. For instance, each electrical connecting component 17 may be stamped with a corresponding one of the marks M, such as the marks ●, ♦ and ★ which are different in shape between the facilities. Alternatively, each component 17 may be stamped with a corresponding one of the marks M which are different in color between the facilities but are the same in shape from one another.

Further, the identification marks M attached to electrical connecting components 17 may be the same in shape and color from one another. In this case, the facility corresponding to each electrical connecting component 17 is identified by that location of the identification mark M on the outer face of the component 17 which is different between the facilities. For instance, in a case where an elongated opening serving as the inspection window is formed in the upper case 11, the identification marks M such as the marks ● are provided at locations, corresponding to one end portion, a central portion, and another end portion of the elongated opening, respectively, on the outer faces of components 17 fabricated by using the facilities 1, 2 and 3, respectively.

It is not inevitably necessary to form the inspection window in the upper case 11, which window is shown at 11*a* in FIG. 1 and exclusively used for inspection. Such an inspection window may be formed in the lower case 12. Furthermore, the inspection window and the identification mark can be constituted in various manners, as explained below.

Figure 3:
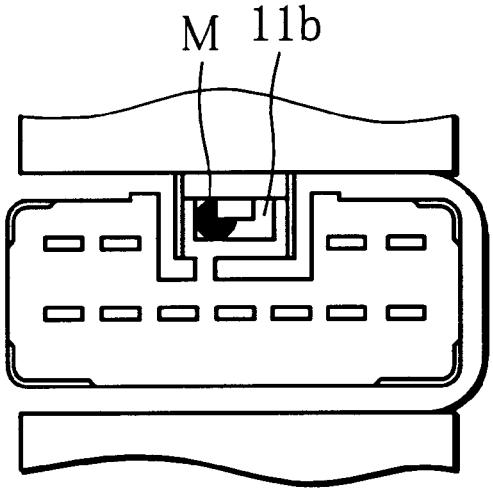
FIG. 3 is a partial top plan view showing an inspection window according to a modification of the present invention.

FIG. 3 shows an inspection window according to a modification of the present invention. In FIG. 3, the upper case 11 is formed with an opening 11*b* to which a harness connector is connected and locked. The opening 11*b* may be utilized as the inspection window by detaching the harness connector from the opening 11*b*. The inspection-window formed portion of the electric connection box of this modification is watertight since the harness connector is usually attached to the opening 11*b* temporally serving as the inspection window. Instead of using the opening 11*b* (lock hole), a water-drain hole formed in the harness-connector connecting portion of the upper case 11 or a similar opening (lock hole) or a drain hole of the lower case 12 may be utilized for the inspection window.

Figure 4:
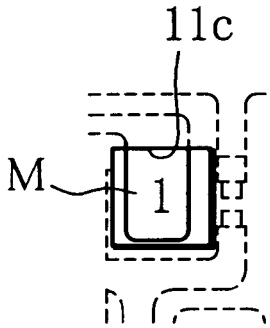
FIG. 4 is a partial top plan view showing an inspection window according to another modification of the present invention.
Figure 5:
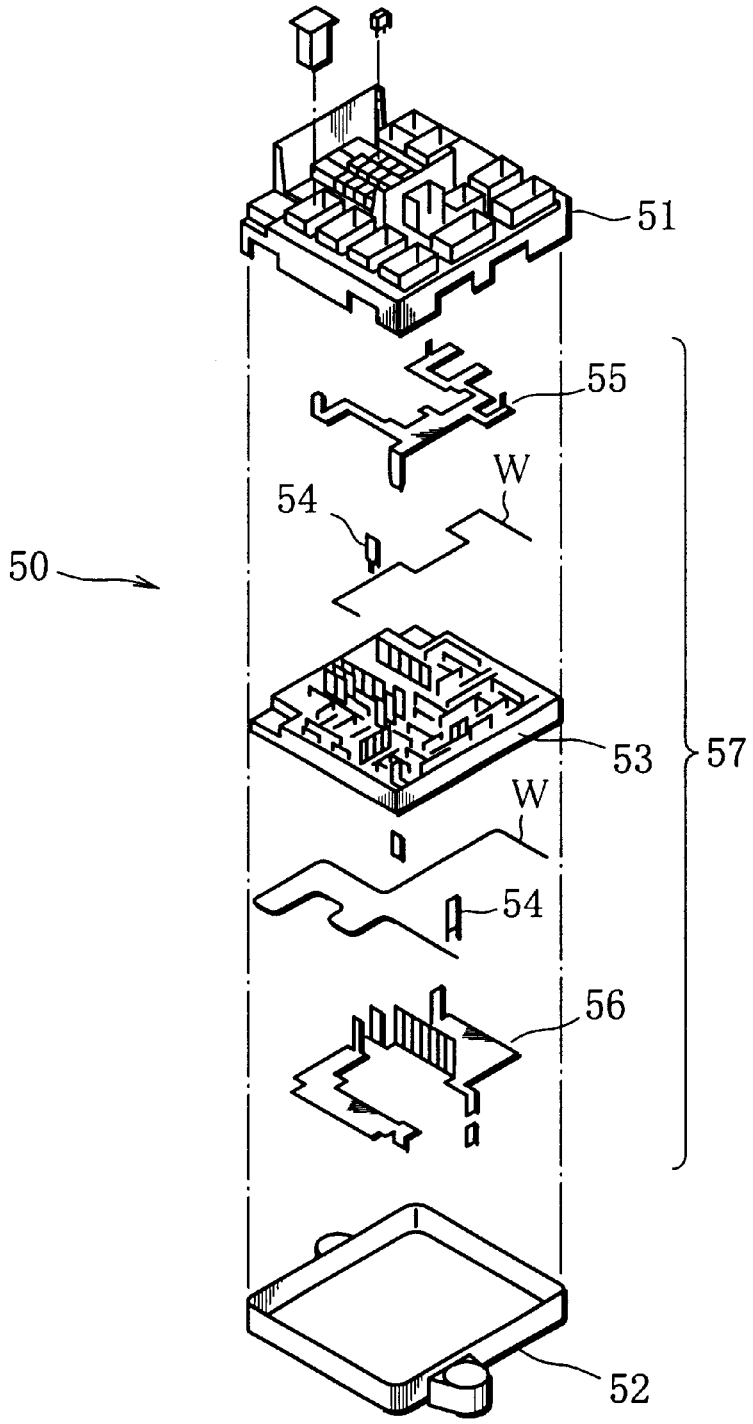
FIG. 5 is an exploded perspective view showing a conventional electric connection box.

FIG. 4 shows the identification mark and the inspection window according to another modification of the present invention.

In injection molding of wiring boards 13, defective molding such as defective formation of reinforcing ribs of wiring boards can be caused due to a fracture of a pin, constituting part of a mold releasing means of the molding die, or due to an injection shortage, for instance. Generally, a defective molding die and a defective molding condition causing defective molding are difficult to find, so that a large number of defective electrical connecting components may be assembled into electric connection boxes before defective molding is uncovered.

The identification mark shown in FIG. 4 is comprised of a corresponding one of Arabic numerals respectively indicative of molding dies employed for production of wiring boards 13. More specifically, different Arabic numerals are engraved in advance in a plurality of molding dies, respectively, so that each individual wiring board 13 may be formed at its outer surface with an Arabic numeral specifying the molding die employed for injection molding thereof. An inspection window 11*c* is formed in advance in the upper or lower case 11 or 12 at a location corresponding to the Arabic-numeral formed portion of each wiring board 13. This enables a worker to visually confirm the Arabic numeral formed on the surface of each wiring board 13 through the window 11*c* from outside of the upper and lower cases 11, 12 even after completion of assemblage of the wiring board to these cases.

If a defective molding die causing the production of defective wiring boards is specified afterward, a worker determines in sequence whether or not individual wiring boards 13 were fabricated by use of the defective molding die on the basis of the Arabic numeral (identification mark) indicated on each wiring board, thereby discriminating electric connection boxes each accommodating a defective wiring board.

Instead of using Arabic numerals to discriminate among molding dies employed for injection molding, identification marks having a shape proper to each molding die may be formed on molding dies in advance, thereby forming a corresponding one identification mark on the outer face of each wiring board during the injection molding thereof. Alternatively, an identification seal, having an identification mark, may be attached to or an identification mark may be stamped on the outer surface of each wiring board or each electrical connecting component after completion of injection molding of the wiring board or of fabrication of the component.

The present invention is not limited to the foregoing embodiment and the modifications thereof, and may be modified variously.

For instance, the internal component, accommodated in the electric connection box and provided with the identification mark, is not limited to the electrical connecting component provided with the wiring board, as in the embodiment and the modifications thereof. That is, the internal component in the present invention may be one which is manufactured with use of a molding machine or an electrical-component mounter or which is not employed for establishing electrical connection. For instance, the internal component of this kind includes an electrical insulating plate or a circuit board on which electrical parts are mounted.

In the preferred embodiment and the modifications thereof, the identification marks respectively attached to products manufactured by different production facilities are different in shape, color, or location from one another. Alternatively, identification marks which are different in a combination of shape, color, and location may be used, to thereby make it easy to discriminate the facility employed for production of each individual internal component.

In the preferred embodiment and the modifications thereof, the identification marks are configured to be visually identified by a worker with ease. Alternatively, the identification marks may be configured to be detected by sensors such as an optical sensor, whereby the quality of the internal component accommodated in each of mass-produced electric connection boxes can be rapidly and automatically determined.

What is claimed is:

1. An electric connection box for use in vehicles, comprising:

a casing formed from an upper case and a lower case;

an internal component accommodated in said casing, wherein said internal component is disposed between said upper and lower cases so that said internal component is fixedly assembled to said upper and lower cases to form a one-piece unit having no moving parts;

an identification mark provided on an outer surface of said internal component for indicating which production facilities were employed for production of said internal component so that if faulty operation of one of said production facilities has been ascertained, said internal component can readily be detected as being defective by said identification mark identifing which of said production facilities said internal component came from; and a single inspection window formed in said casing for permitting inspection to ascertain said identification mark from outside of said casing.

2. The electric connection box according to claim 1, wherein said identification mark has a particular shape indicative of which of the production facilities was employed for production of said internal component.

3. The electric connection box according to claim 1, wherein said identification mark has a particular color indicative of which of the production facilities was employed for production of said internal component.

4. The electric connection box according to claim 1, wherein said identification mark is provided at different locations on said outer surface of said internal component which is indicative of which of the production facilities was employed for production of the internal components.

5. The electric connection box according to claim 1, wherein said identification mark specifies a molding die employed for production of said internal component.

6. The electric connection box according to claim 1, wherein said internal component is an electrical connecting component including a wiring board.

7. The electric connection box according to claim 6, wherein said wiring board is formed with a wiring groove in which a wire is installed.

8. The electrical connection box according to claim 1, wherein said indentification mark is configured to be visually identified by a worker through said inspection window.

* * * * *